US009510662B1

(12) United States Patent
Bruns et al.

(10) Patent No.: US 9,510,662 B1
(45) Date of Patent: Dec. 6, 2016

(54) MOVEMENT, TILT, AND SECUREMENT FEATURES FOR A STRUCTURE, PARTICULARLY A WEARABLE ARTICLE

(71) Applicants: Judi Bruns, Lake Junaluska, NC (US); Dan Bruns, Lake Junaluska, NC (US)

(72) Inventors: Judi Bruns, Lake Junaluska, NC (US); Dan Bruns, Lake Junaluska, NC (US)

( * ) Notice: Subject to any disclaimer, the term of this patent is extended or adjusted under 35 U.S.C. 154(b) by 0 days.

(21) Appl. No.: 15/179,239

(22) Filed: Jun. 10, 2016

Related U.S. Application Data

(63) Continuation-in-part of application No. 14/573,298, filed on Dec. 17, 2014.

(60) Provisional application No. 62/282,899, filed on Aug. 14, 2015.

(51) Int. Cl.
*A45F 5/02* (2006.01)
*A45F 5/00* (2006.01)
*A45C 11/00* (2006.01)

(52) U.S. Cl.
CPC ..... *A45F 5/00* (2013.01); *A45C 11/00* (2013.01); *A45F 5/021* (2013.01); *A45C 2011/001* (2013.01); *A45C 2011/002* (2013.01); *A45C 2011/003* (2013.01)

(58) Field of Classification Search
CPC ..... A45F 5/021; A45F 5/02; A45F 3/04; A45F 2005/027; A45F 2005/028; A45F 2200/0516; A45C 3/06
USPC ..... 224/195–197, 200, 660, 271, 930
See application file for complete search history.

(56) References Cited

U.S. PATENT DOCUMENTS 6,082,034 A * 7/2000 Musmanno ..... F41B 5/1461 42/94
6,359,609 B1 * 3/2002 Kuenster ..... G06F 1/163 224/270
7,110,802 B1 * 9/2006 Kim ..... H04B 1/3888 224/269
7,624,955 B2 * 12/2009 McGill ..... F16M 13/00 248/181.1
8,056,780 B1 * 11/2011 Bruns ..... A44B 11/005 224/163
8,070,026 B2 * 12/2011 Wadsworth ..... A45C 11/00 224/197
8,267,294 B2 * 9/2012 Yu ..... A45F 3/10 224/623
8,505,790 B2 * 8/2013 Yu ..... A45F 5/00 224/185
8,881,961 B1 * 11/2014 Cibirka ..... A45F 5/00 2/268
8,998,161 B2 * 4/2015 Larson ..... F16M 11/10 248/441.1

(Continued)

*Primary Examiner* — Corey Skurdal
(74) *Attorney, Agent, or Firm* — John L Sotomavor

(57) ABSTRACT

There is provided an apparatus for securing a compact portable device to an external arrangement and the device includes a base attachable to the external arrangement, a panel, an attachment for securing the compact portable device to the panel. The movement element movably connecting the panel to the base in a manner such that the panel can selectively be oriented in one orientation to support the compact portable device generally facing relationship to the base generally and in another orientation in which the compact portable device is not in generally facing relationship to the base. The apparatus having a swivel portion, permitting a mobile device to be placed in either vertical or horizontal orientation with respect to the tongue and base of the apparatus.

10 Claims, 17 Drawing Sheets

(56) References Cited

U.S. PATENT DOCUMENTS

| | | | | |
|---|---|---|---|---|
| 2005/0092791 | A1* | 5/2005 | Labarca | A45F 5/02<br>224/269 |
| 2006/0138301 | A1* | 6/2006 | Kaufman | A45F 3/14<br>248/682 |

* cited by examiner

MOVEMENT, TILT, AND SECUREMENT FEATURES FOR A STRUCTURE, PARTICULARLY A WEARABLE ARTICLE

PRIORITY CLAIM

This Non-Provisional application claims under 35 U.S.C. §120, the benefit of priority as a Continuation-in-Part to the Non-Provisional application Ser. No. 14/573,298, filed Dec. 17, 2014 titled "Movement and Securement features for a Structure, Particularly a Wearable Article", and to Provisional Application 62/282,899, filed Aug. 14, 2015, titled "Rotating Mechanism for an Encasement Which is part of a Wearable Apparatus", each of which is hereby incorporated by reference in its entirety.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND 2-3 paragraphs of the state of the industry in which the innovation will be sold.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
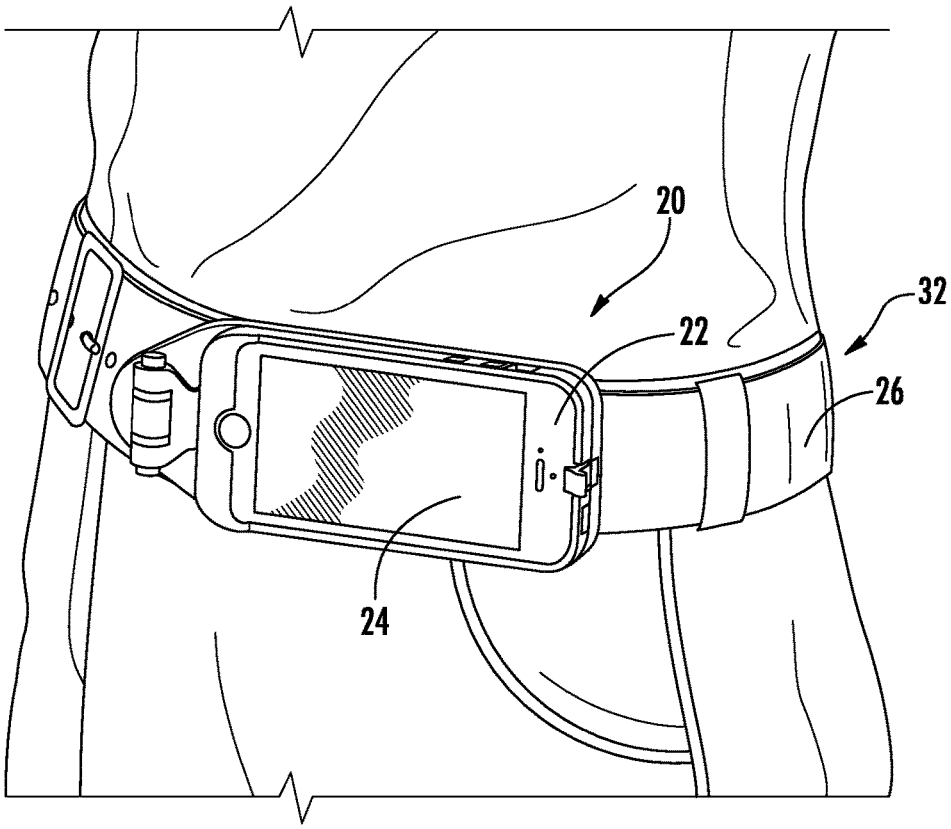
FIG. 1 is a view of the present invention attached to an article in the representative form of a belt consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

According to one aspect of the present invention, there is provided an assembly consisting of a top encasement, a base plate, and a tilt and rotate mechanism in which a compact portable device can be secured and attached to an article. The assembly consists of moving parts which provide the ability of the user to wear, attach (to a belt or strap for example) tilt open the top encasement up to and including 270 degrees (although the typical degree of tilt is about 180 degrees this may be extended to include 270 degrees), and rotate the top encasement around 360 degrees freely in either direction. The compact portable device may or may not include a viewing screen.

According to another aspect of the present invention, there is provided an apparatus used to hold a compact portable device consisting of one or more clenching dips that allow the user to safely and securely attach the apparatus to a number of items.

According to a further aspect of the present invention, there is provided a unit consisting of a top encasement, a base plate, a rotating mechanism, a tongue extension, and a clenching" dip attached to the base plate. The unit consists of moving parts which provide the ability of the user to wear attach (to a belt or strap for example), tilt open the top encasement, rotate the top encasement from side to side in either direction, and rotate the top encasement, around 360 degrees freely in either direction.

In an exemplary embodiment, when the top encasement is opened up away from the base, the top encasement which is attached to the tongue extension plate by a rotating mechanism, not only can be tilted back and forth and rotated 360 degree in reference to the base; but it can also be rotated 360 degrees in reference to the tongue extension panel.

The top encasement, containing a receiving element for the rotating mechanism, can easily be attached and reattached to the tongue extension plate's rotating mechanism, which is part of the tongue extension plate. When the top encasement is attached to the rotating mechanism, it can be freely and selectively be rotated in a circle of 360 degrees.

This versatility of circular motion allows the user to choose the angle or direction with which they want to view the compact portable device which is encased within the top encasement; selectively orientated vertically, horizontally, or any degree of rotation within the 360 degrees.

With reference to further details of the one aspect of the present invention, there is provided an assembly consisting of a top encasement, a base plate, and a tilt and rotate mechanism in which a compact portable device can be secured and attached to an article. The assembly consists of moving parts which provide the ability of the user to wear, attach (to a belt or strap for example), tilt open the top encasement up to and including 270 degrees (although the typical degree of tilt is about 180 degrees, this may be extended to include 270 degrees), and rotate the top encasement around 360 degrees freely in either direction. The compact portable device may or may not include a viewing screen.

The compact portable device is representative of any one of a number of devices such as but not limited to examples such as a personal digital assistant (PDA), cellular telephone, smart device, smart phone, tablet, "note" style tablet, portable music/media player, video game device, and satellite radio receiver. The tilt and rotate mechanism is to include but not limited to; being a part of the actual chassis of the compact portable device, a part of the top encasement that surrounds the compact portable device, or part of the base plate of the assembly itself to which the tool encasement can be attached. In this illustration, for example, the tilt and rotation is made possible by the design and assembly of the mechanism configured within the baseplate. The top encasement can be closed onto the base plate in a manner such that it can be selectively orientated; allowing the viewing screen to be seen or hidden if applicable. When the encasement is not closed, it can be selectively oriented with the top encasement extended outwardly to any degree up to 270 degrees and turned and rotated any degree up to and including 360 degrees for viewing the viewing screen of the compact portable device if applicable. The top encasement, which holds the compact portable device, is attachable and detachable to the base plate via a tongue extension of the base plate for example, which attaches to the back of the encasement.

In one aspect the user can attach the assembly to a purse for example, and keep the top encasement closed facing out or closed facing in. In another aspect, the user can attach the assembly to a belt for example, tilt the top encasement out any degree decided between zero and 270, and in addition, rotate the top encasement from zero to 360 degrees and either direction they decide in order to view the compact portable device, which is secured inside of the top encasement. The user therefore, is given the freedom to lie down, stand, walk, hike, bike, etc. and still have immediate, hands free access to the compact portable device without having to remove it from the assembly. The users have numerous varying degrees of tilt and rotation of said apparatus simultaneously.

Turning now to FIG. 1, this figure presents a view of the present invention attached to an article in the representative form of a belt consistent with certain embodiments of the present invention. In an exemplary embodiment, the assembly embodying the invention and generally designated 20 is shown securing a compact portable device 22 in the representative form of a "smartphone", such as an iPhone, including a viewing screen 24, to an article 32 in the representative form of a belt 26 for example that may be carried by or worn by a person. The compact portable device 22 is representative of any number of suitable devices.

Figure 2:
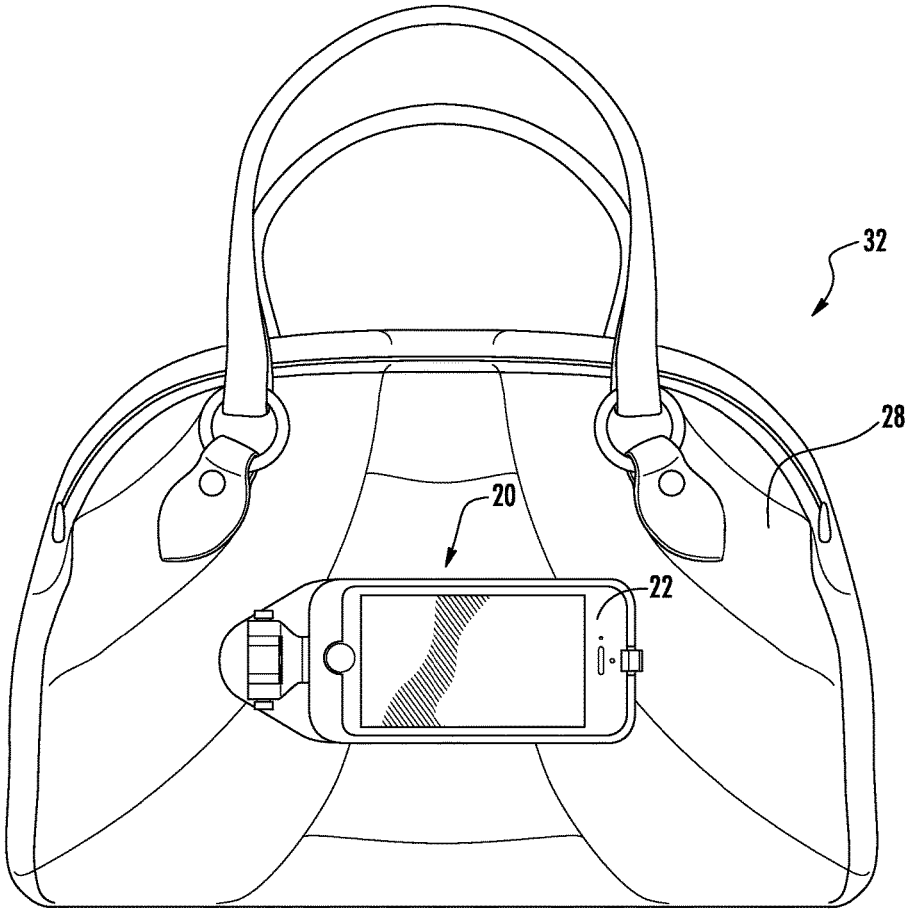
FIG. 2 is a view of the invention attached to an article in the representative form of a purse consistent with certain embodiments of the present invention.

Turning now to FIG. 2, this figure presents a view of the invention attached to an article in the representative form of a purse consistent with certain embodiments of the present invention. In an exemplary embodiment, the system presents the assembly 20, with an attached compact portable device 22, which is attached to an article 32 in the representative form of a purse 28. The means of attachment in this example may be in the form of rivets. This is only one example of several methods of attachment such as clips, pins, and screws.

Figure 3:
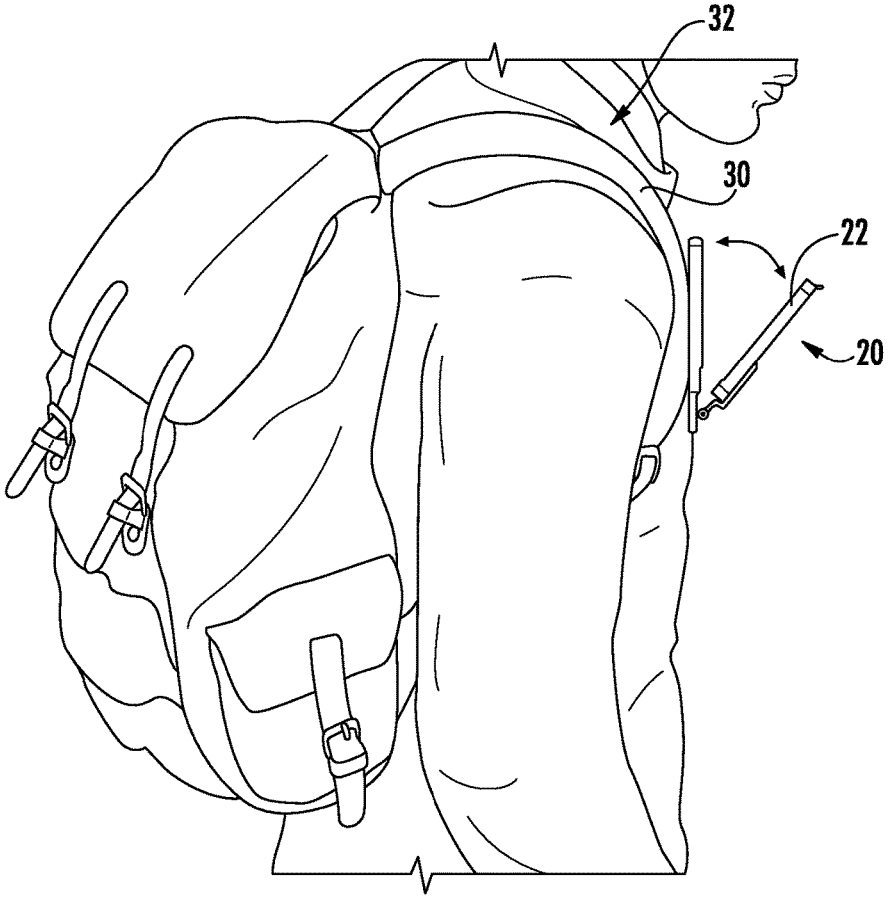
FIG. 3 is a view of the invention attached to an article in the representative form of a backpack consistent with certain embodiments of the present invention.

Turning now to FIG. 3, this figure presents a view of the invention attached to an article in the representative form of a backpack consistent with certain embodiments of the present invention. In an exemplary embodiment, the assembly 20, with an attached compact portable device 22, is attached to an article 32 is in the representative form of a strap on a backpack 30. The means of attachment in this example may be in the form of a clip. This is only one example of several methods of attachment such as rivets, pins, and screws. As noted above, the belt 26, the purse 28, and the strap of a backpack 30 are representative forms of an article 32. It will be appreciated that the assembly 20 may be used to secure a compact portable device 22 to other articles 32 (not shown) carried or worn by a person. Other examples are a waistband, a backpack itself, or a stand.

Figure 4:
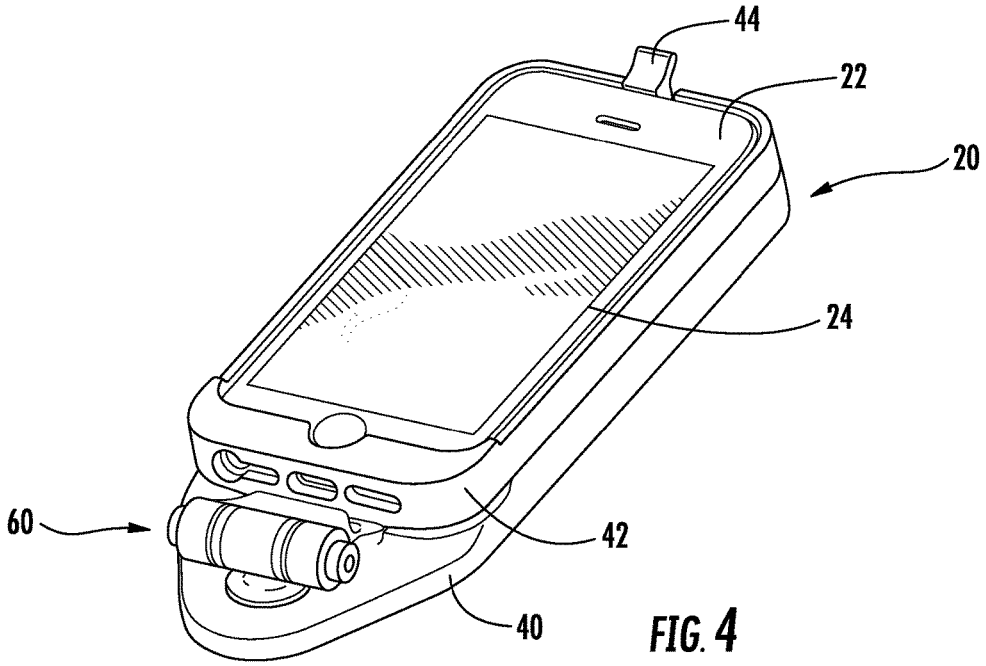
FIG. 4 is a three dimensional view of the assembly with the top encasement closed with the compact portable device facing outward consistent with certain embodiments of the present invention.

Turning now to FIG. 4, this figure presents a three dimensional view of the assembly with the top encasement closed with the compact portable device facing outward consistent with certain embodiments of the present invention. In an exemplary embodiment, the assembly 20 in the "closed facing up" orientation; meaning the compact portable device 22 viewing screen 24 is visible when closed. The assembly 20 more particularly includes a base plate 40, a top encasement 42 (which holds a compact portable device 22), a closure clip 44, and a tilt and rotate mechanism 60.

Figure 5:
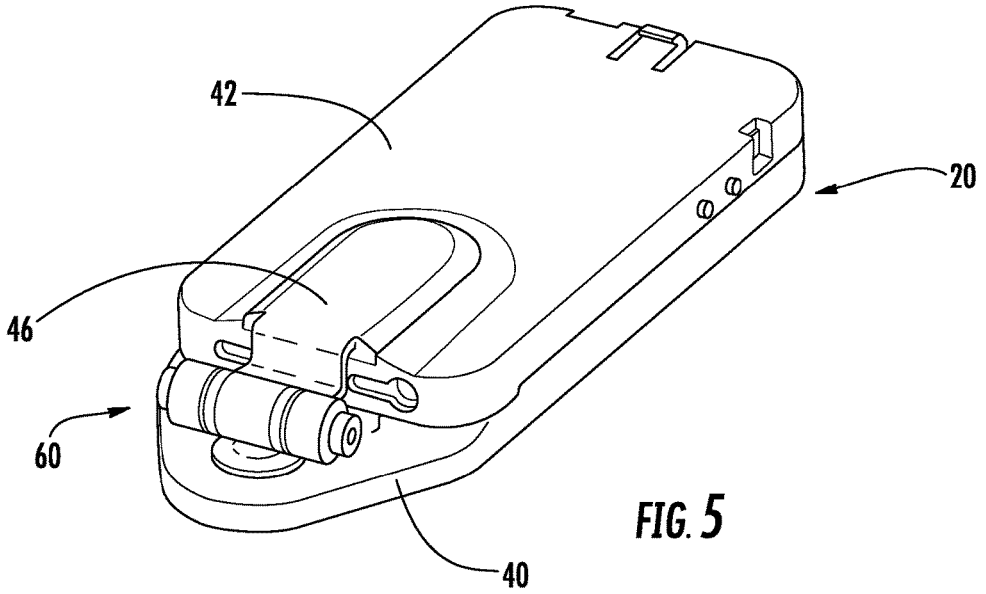
FIG. 5 is a three dimensional view of the assembly with the top encasement closed with the compact portable device facing in consistent with certain embodiments of the present invention.

Turning now to FIG. 5, this figure presents a three dimensional view of the assembly with the top encasement closed with the compact portable device facing in consistent with certain embodiments of the present invention. In this embodiment, the figure illustrates the assembly 20 in the "closed facing down" orientation; meaning the compact portable device 22 and viewing screen 24 is not visible when closed. This orientation illustrates the tongue extension 46 when attached to the top encasement 42, as well as the tilt and rotates mechanism 60, which is part of the base plate 40.

Figure 6:
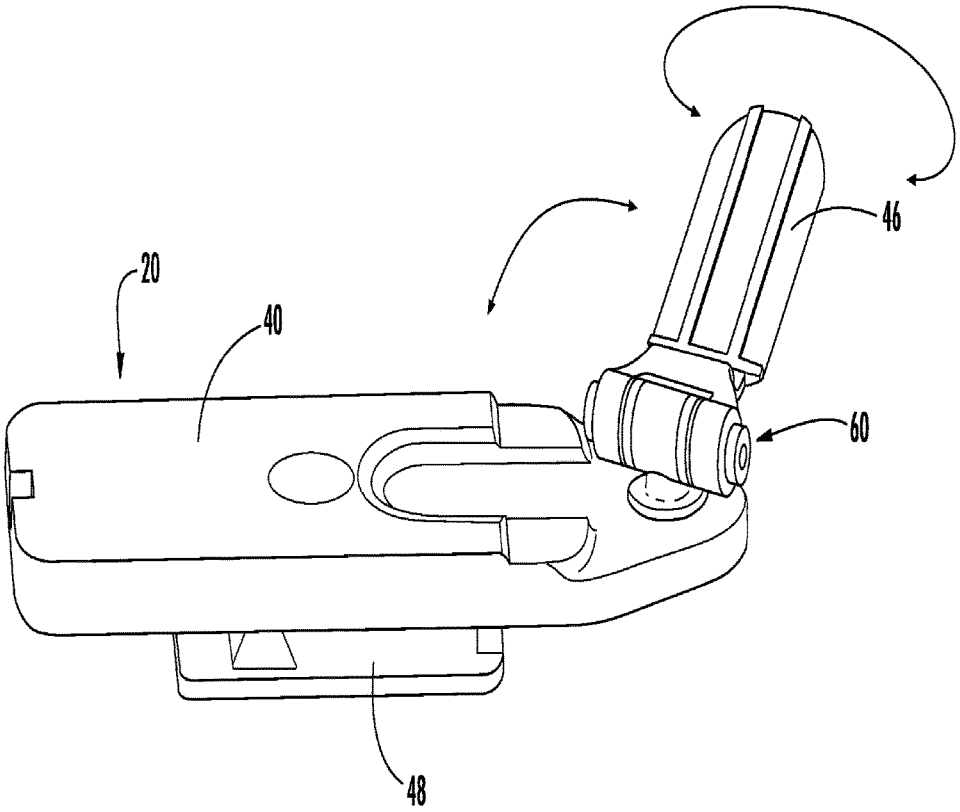
FIG. 6 is a view of a three dimensional view of the assembly with the top portion tilted outwardly and turned consistent with certain embodiments of the present invention.

Turning now to FIG. 6, this figure presents a view of a three dimensional view of the assembly with the top portion tilted outwardly and turned consistent with certain embodiments of the present invention. In this exemplary embodiment, the figure illustrates the assembly 20 with its base plate 40 fully exposed as the tilt and rotate mechanism 60 has been tilted outwardly between 90 and 180 degrees and rotated between 0 and 90 degrees from center. The top encasement 42 has been removed from the tongue extension 46. Underneath the base plate 40, an article attaching clip 48 for example, as a means of attaching to an article 32. The article-attaching clip 48 is merely an example of one of many ways to attach the assembly 20 to an article 32.

Figure 7:
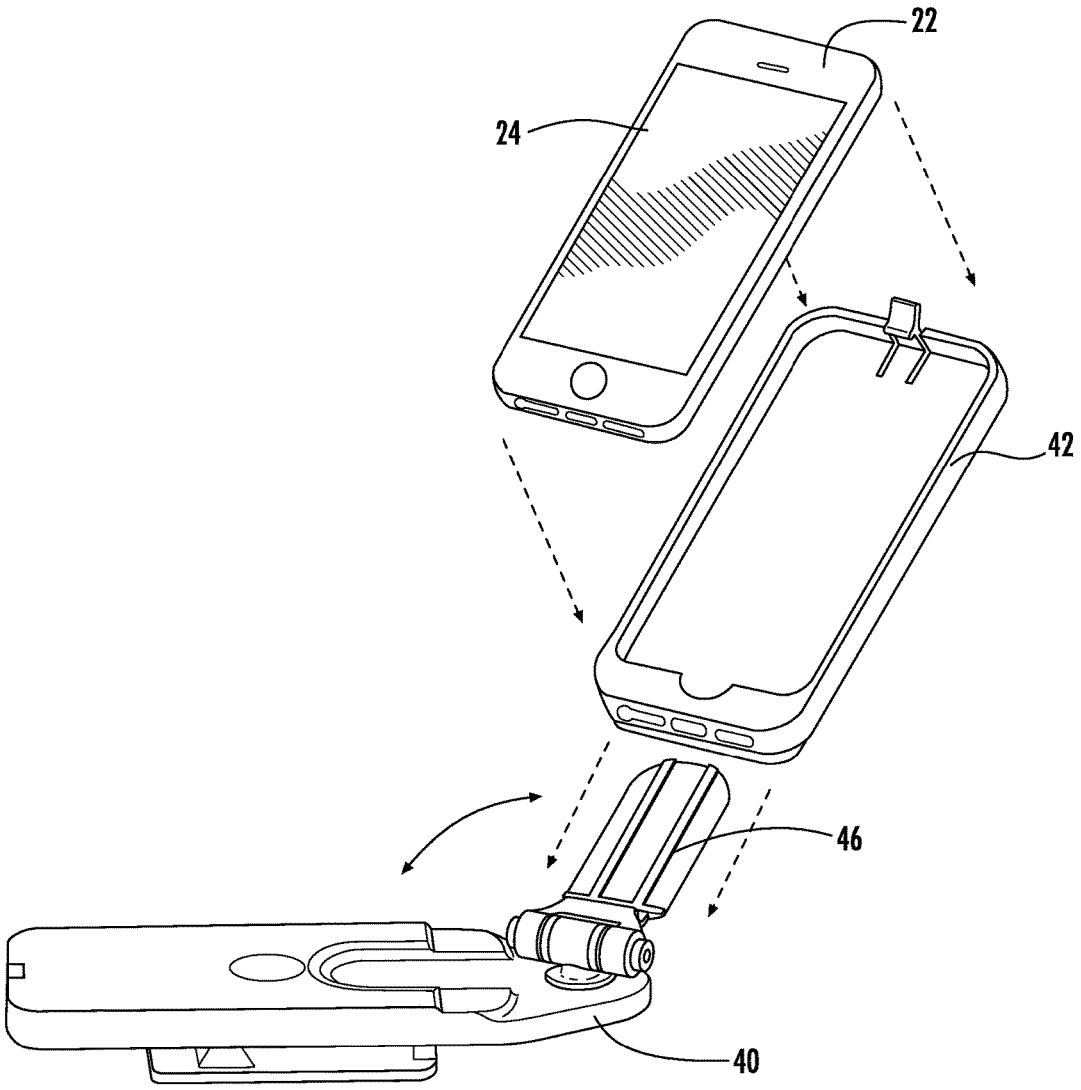
FIG. 7 is a three dimensional view of the assembly with the top portion tilted outwardly and turned demonstrating the manner in which the top encasement will receive the compact portable devices, as well as demonstrate the manner in which the base plate tongue extension will receive the top encasement consistent with certain embodiments of the present invention.

Turning now to FIG. 7, this figure presents a three dimensional view of the assembly with the top portion tilted outwardly and turned demonstrating the manner in which the top encasement will receive the compact portable devices, as well as demonstrate the manner in which the base plate tongue extension will receive the top encasement consistent with certain embodiments of the present invention. This figure illustrates the manner in which a compact portable device 22 with viewing screen 24 sets into the top encasement 42 as well as how the top encasement 42 attaches to the tongue extension 46 which is part of the base plate 40.

Figure 8:
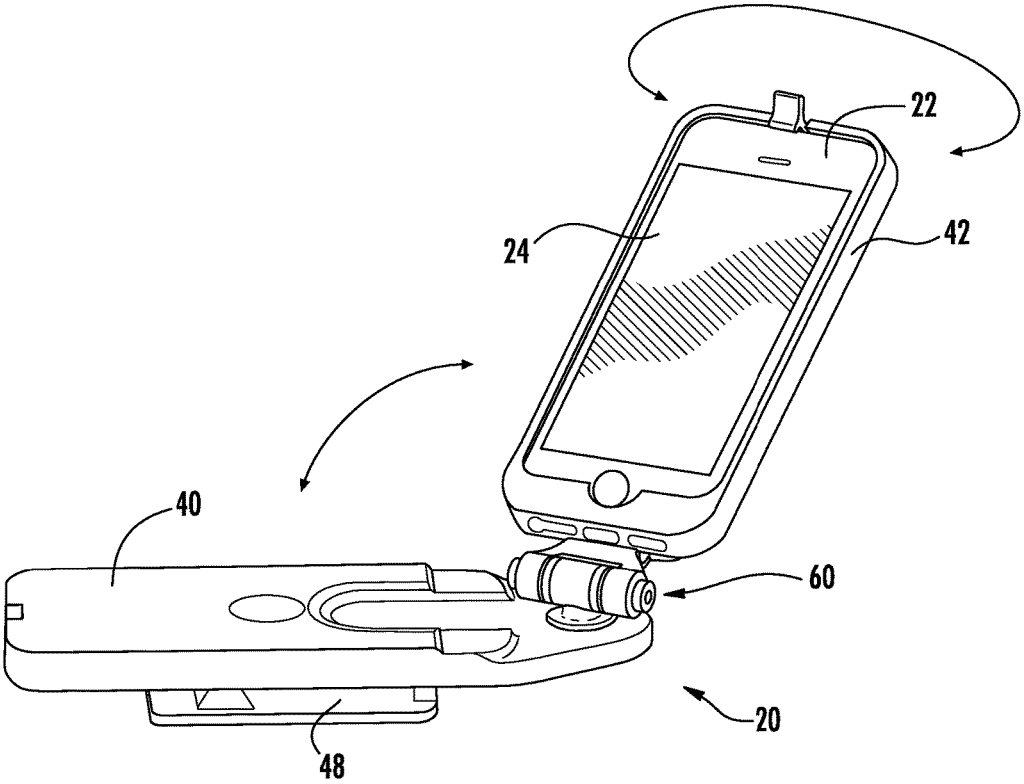
FIG. 8 is a three dimensional view of the assembly with the top encasement and a compact portable device attached and tilted outwardly and rotated consistent with certain embodiments of the present invention.

Turning now to FIG. 8, this figure presents a three dimensional view of the assembly with the top encasement and a compact portable device attached and tilted outwardly and rotated consistent with certain embodiments of the present invention. In this exemplary embodiment, the assembly 20 is positioned in one of many varying degree "open" positions. The base plate 40 is seen with the article-attaching dip 48 on the bottom of it. The tilt and rotate mechanism 60 has been tilted outwardly between 90 and 180 degrees and rotated between 0 and 90 degrees from center. The top encasement 42 is seen here with an attached compact portable device 22 with a viewing screen 24.

Figure 9:
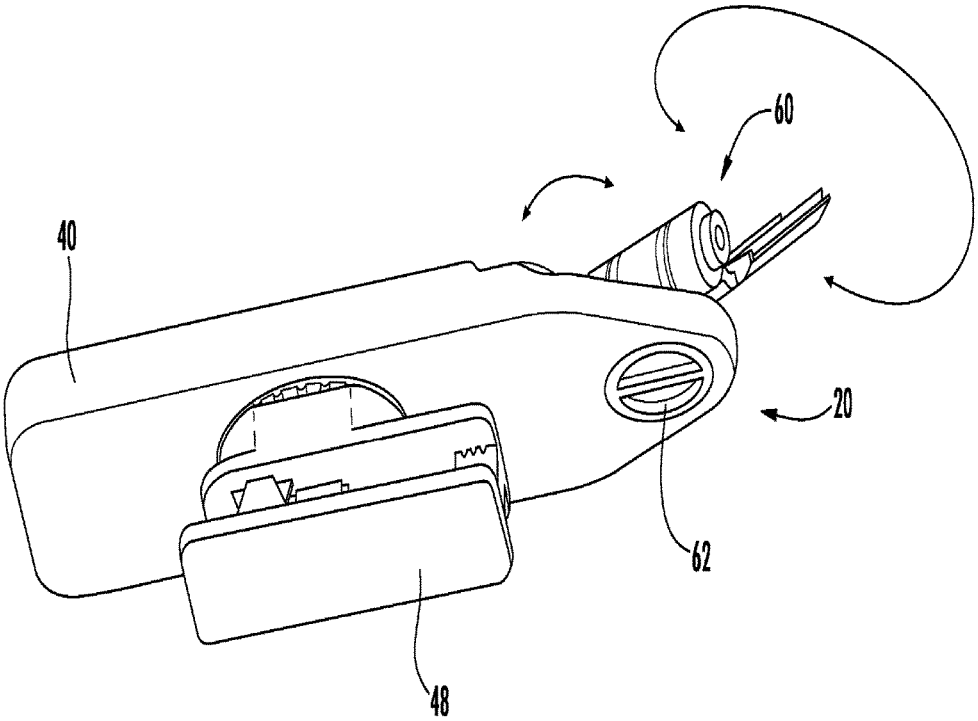
FIG. 9 is a view of the apparatus rotated upward to show the back (bottom) of the base plate consistent with certain embodiments of the present invention.

Turning now to FIG. 9, this figure presents a view of the apparatus rotated upward to show the back (bottom) of the base plate consistent with certain embodiments of the present invention. In this exemplary embodiment, a larger view of the bottom of the base plate 40 of the assembly 20. The article-attaching dip 48 is seen as well as the tension cap 62, which is part of the tilt and rotate mechanism 60, is presented.

Figure 10:
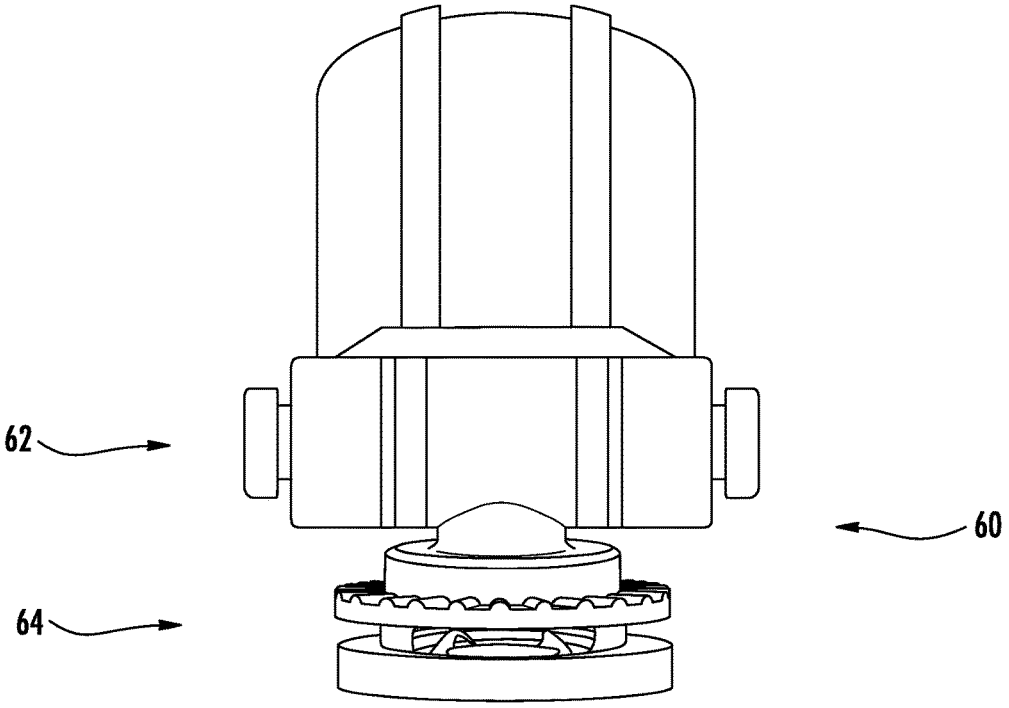
FIG. 10 is a view of the tilt and rotates mechanism which is part of the base plate consistent with certain embodiments of the present invention.

Turning now to FIG. 10, this figure presents a view of the tilt and rotate mechanism, which is part of the base plate consistent with certain embodiments of the present invention. In this exemplary embodiment, the figure is an isolated three-dimensional view of the tilt and rotate mechanism 60, which is part of the base plate 40 of the assembly 20. The tilt and rotate mechanism 60 is now broken down into two parts: the tilt assembly 62 and the rotate assembly 64.

Figure 11:
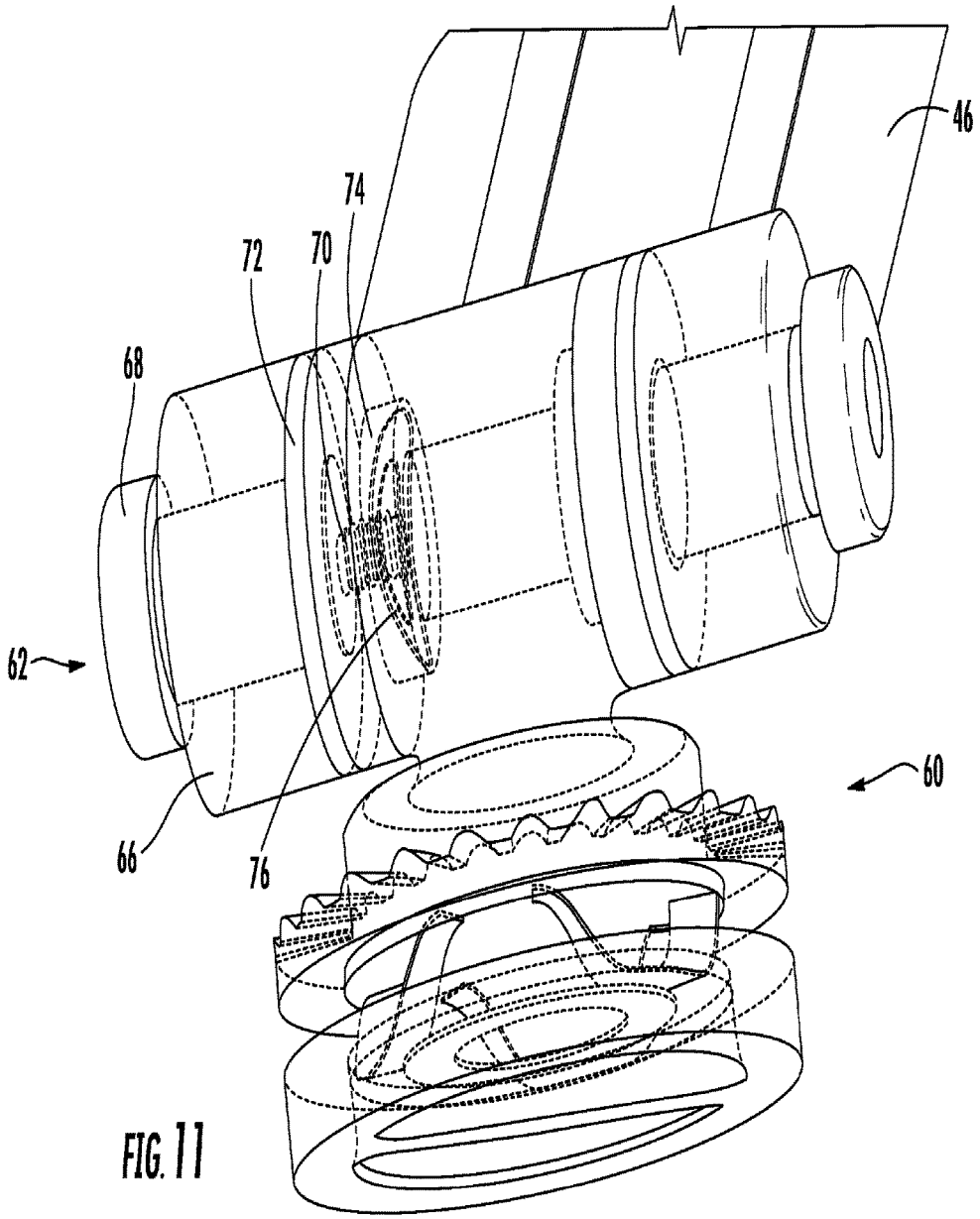
FIG. 11 is a view of the tilt and rotate mechanism with increased visualization of the tilt assembly consistent with certain embodiments of the present invention.

Turning now to FIG. 11, this figure presents a view of the tilt and rotate mechanism with increased visualization of the tilt assembly consistent with certain embodiments of the present invention. In this exemplary embodiment, this figure presents an enlarged three-dimensional view of the tilt and rotate mechanism 60 with special focus being placed upon the tilt assembly 62. The tilt assembly 62 is part of the base plate 40 of the assembly 20 as well as the tongue extension 46. Within the hinge leaf 66, there is a hinge pin button assembly 68 containing a screw 70 in the center of it. A rubber washer 72 is placed between the hinge pin base 74 and the hinge leaf 66. The screw 70 applies tension to the tension washer 76 which will then applies tension to the till assembly 62 in general. This design s duplicated on both sides.

Figure 12:
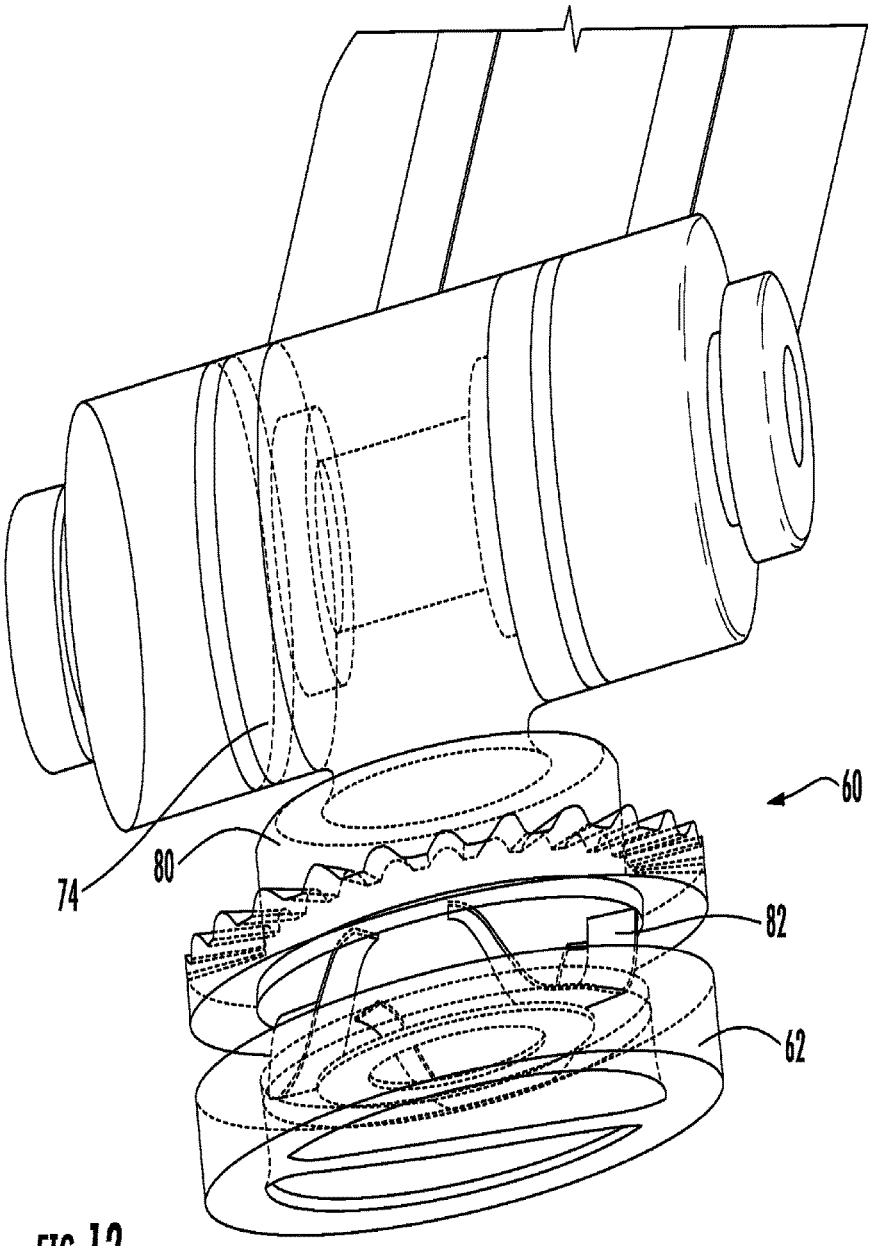
FIG. 12 is a view of the tilt and rotate mechanism with increased visualization of the rotate assembly consistent with certain embodiments of the present invention.

Turning now to FIG. 12, this figure presents a view of the tilt and rotate mechanism with increased visualization of the rotate assembly consistent with certain embodiments of the present invention. In this exemplary embodiment, an enlarged three-dimensional view of the tilt and rotate mechanism 60 with special focus being placed upon the rotate assembly 64. The hinge knuckle mechanism 80, which is connected to the hinge pin base 74, is able to rotate 0 to 360 degrees via the tension leaf spring 82 controlled by the amount of pressure put on it by the tension cap 62. The tilt and rotate mechanism 60 including the tongue extension 46, provides a connection between the moveable top encasement 42 and the base plate 40, and in addition is detachable. Significantly, the tilt and rotate mechanism 60 and the tongue extension 46 allow the top encasement 42 containing a compact portable device 22 to be selectively oriented with reference to the base plate 40 in various positions and orientations. The tilt assembly 62 allows zero to 270 degrees of tilt outward from the base plate 40. The rotate assembly 64 allows zero to 360 degrees of rotation simultaneously during varying degrees of tilt.

With reference to further details of the another aspect of the present invention, there is provided an apparatus used to hold a compact portable device consisting of one or more clenching dips that allow the user to safely and securely attach the apparatus to a number of items. The compact portable device in which the apparatus will serve is representative of any one of a number of devices such as but not limited to examples such as a personal digital assistant (FDA), cellular telephone, smart device, smart phone, tablet, "notebook style" tablet, portable music/media player, video game device, and satellite radio receiver.

One feature of this apparatus is the attaching clips. The dips can be used independently or dependently. The dips are what secures the apparatus to varying objects such as but not limited to a strap or belt for example. The apparatus does not necessarily have to be clenched down into a notch in order for it to be effective. It can remain in the open "un-notched" position and be dipped onto a belt for example. Often however, straps are vertical and the ability to keep the apparatus from sliding down requires a firm steady attachment and therefore the need for the clenching clips. Due to the manner of differing thicknesses of many items the apparatus is being attached to, the clips themselves can vary in the amount of "'clenching each clip is given. The degree of "clenching can be easily changed by pushing the clip portion with its clipping pin down into the notches on the apparatus itself, or lifting the clip with its clipping pin up out and off of the notches to unclench it. The clipping pin, when snugly put into one of the notches, allow the clip to safely hold its position.

There are varying degrees of clenching strength and/or depth depending on the notch used when using the clenching clips. The first notch, the notch closest to the clip when it is in the "un-notched" open position, allows for a thicker item that the apparatus can be attached to, the second notch—a little thinner item, the third notch—an even thinner item, and so on. The individual dips can be clenched into different notches at the same time, meaning: one dip tap A for example) can be clenched into the first notch (Number 1 for example) attaching to a thick item, and the other dip (Clip B for example) can be attached to a thin item and clenched into a deeper notch (Notch 3 for example). The ability to securely attach the apparatus to items of varying thickness allows the user to let go with confidence that the apparatus will not slide off of the item such as a strap or belt for example.

Figure 13:
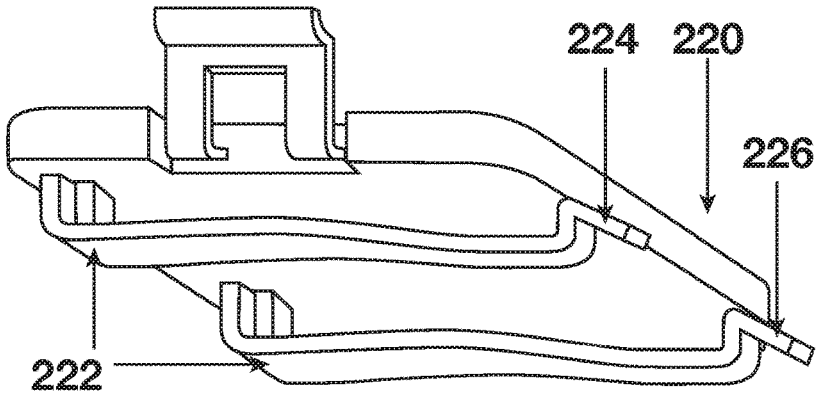
FIG. 13 is a view of the present invention with both clips open, and "un-notched" consistent with certain embodiments of the present invention.

Turning now to FIG. 13, this figure presents a view of the present invention with both clips open, or "un-notched", consistent with certain embodiments of the present invention. The apparatus embodying the invention and generally designated 220 includes a pair of clips 222 comprised of a Clip A 224 and a Clip B 226 both shown in the open un-notched position.

Figure 14:
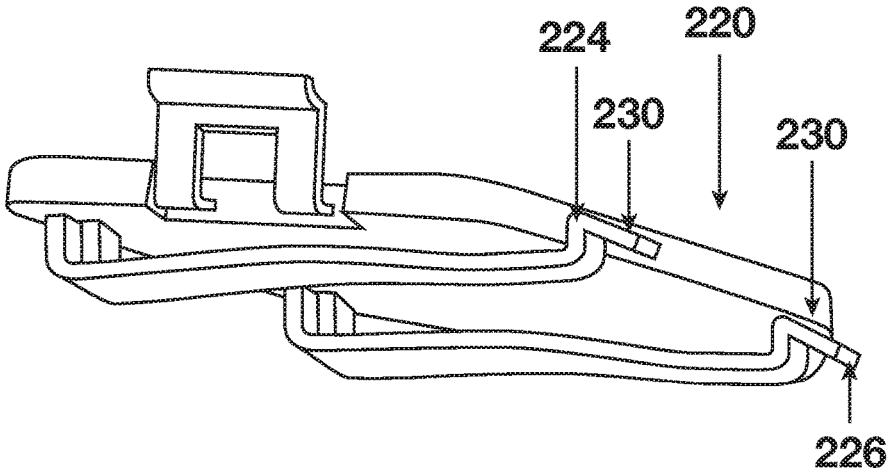
FIG. 14 is a view of the invention with 1 clip open and un-notched, and the other clip clenched into a notch consistent with certain embodiments of the present invention.

Turning now to FIG. 14, this figure presents a view of the invention with 1 clip open and un-notched, and the other clip clenched into a notch consistent with certain embodiments of the present invention. In this embodiment, the apparatus 220 is shown with Clip A 224 clenched into a plurality of notches 230 and Clip B 226 in the open un-notched position.

Figure 15:
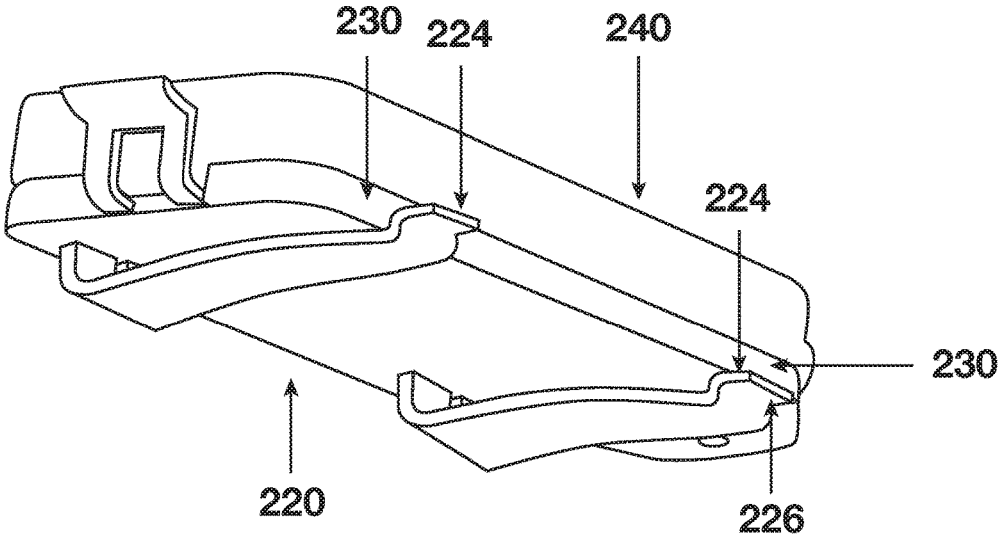
FIG. 15 is a view of with a compact portable device attached to the apparatus consistent with certain embodiments of the present invention.

Turning now to FIG. 15, this figure presents a view of a compact portable device attached to the apparatus consistent with certain embodiments of the present invention. This embodiment shows the apparatus with a compact portable device 240 in the representative form of a "smartphone", such as an iPhone, attached to the apparatus 320. As shown in FIG. 14, Clip A 224 is clenched into the notches 230 and Clip B 226 is in the open un-notched position.

Figure 16:
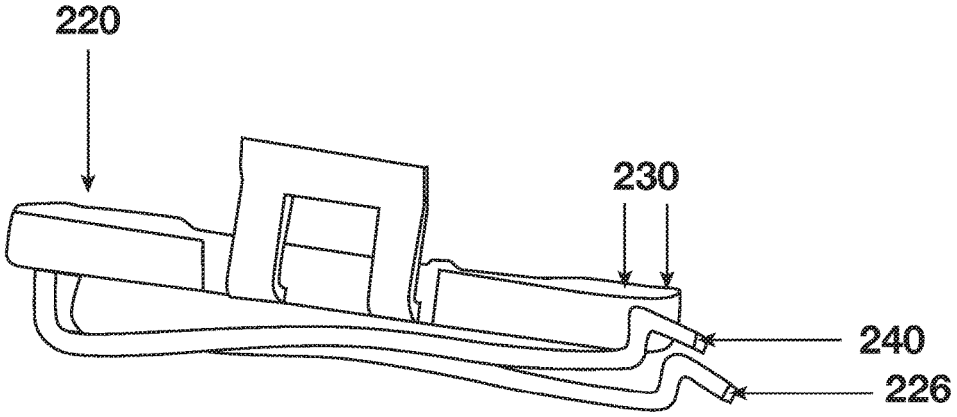
FIG. 16 is a view of the invention with one clip clenched in a notch and the other clip un-notched consistent with certain embodiments of the present invention.

Turning now to FIG. 16, this figure presents a view of the invention with one clip clenched in a notch and the other clip un-notched consistent with certain embodiments of the present invention. This embodiment presents an end view of the apparatus 220 embodying the invention with Clip A 224 clenched into the notches 230 and Clip B 226 in the open un-notched position.

Figure 17:
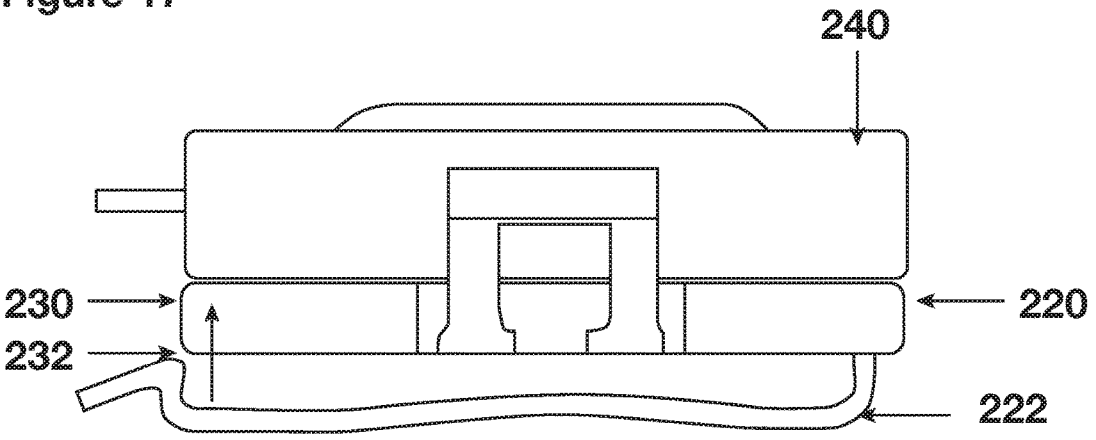
FIG. 17 is a view of both clips open and un-notched showing the detail of the clipping pin consistent with certain embodiments of the present invention.

Turning now to FIG. 17, this figure presents a view of the invention with one clip clenched in a notch and the other clip un-notched consistent with certain embodiments of the present invention. This embodiment presents a three dimensional end view of the apparatus 220 with an attached compact portable device 340. This view shows a dipping pin 232 on the dips 222 that secures into the notches 230.

Figure 18:
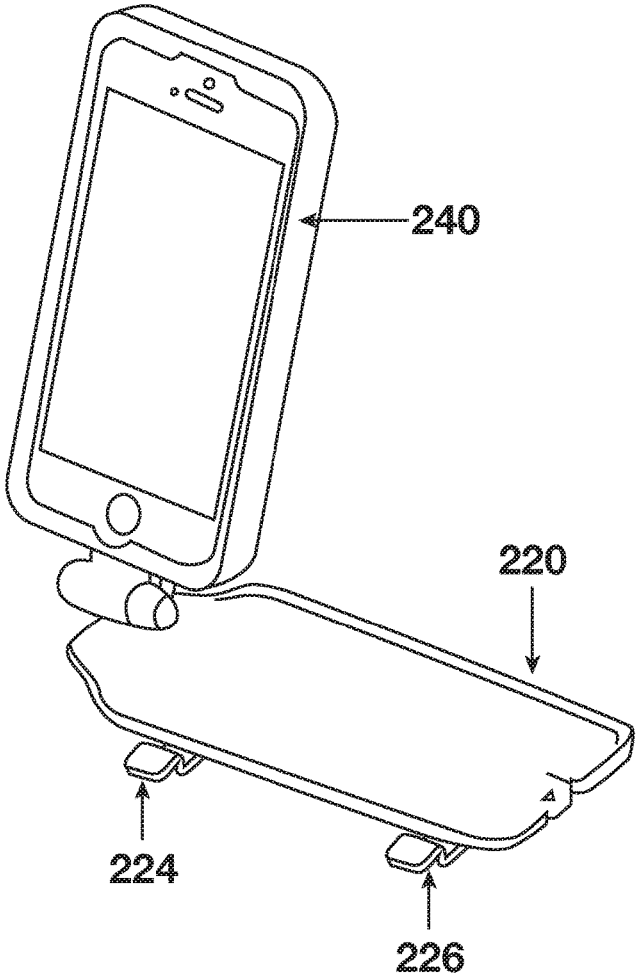
FIG. 18 is a three dimensional view of the apparatus with an attached compact portable device and both clips in the open un-notched position consistent with certain embodiments of the present invention.

Turning now to FIG. 18, this figure presents a three dimensional view of the apparatus with an attached compact portable device and both clips in the open un-notched position consistent with certain embodiments of the present invention. This embodiment presents a three dimensional view of the apparatus 220 with an attached compact portable device 240. Both Clip A 224 and Clip B 226 are shown in the open un-notched position.

Figure 19:
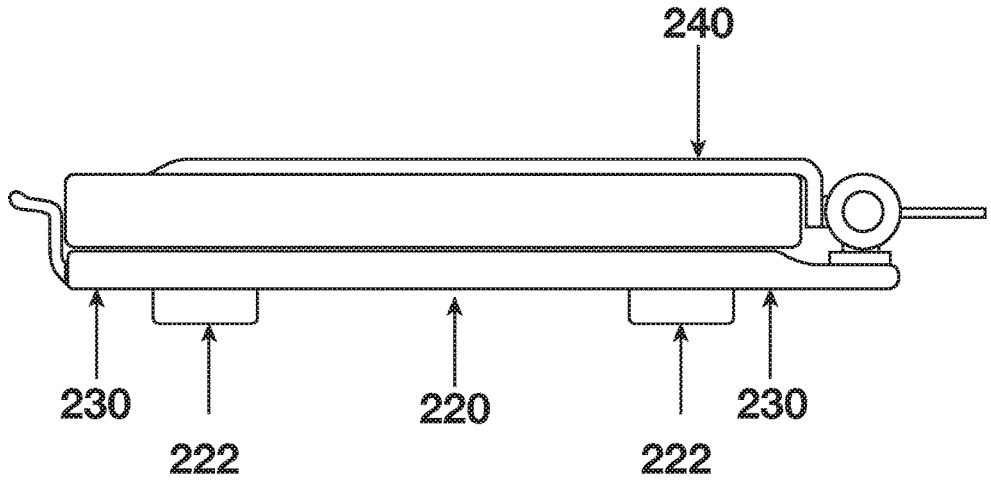
FIG. 19 is a view of the notches for closing the clips are on both sides of the apparatus so the clips can be orientated on either side of the apparatus consistent with certain embodiments of the present invention.

Turning now to FIG. 19, this figure presents a view of the notches for closing the clips are on both sides of the apparatus so the clips can be orientated on either side of the apparatus consistent with certain embodiments of the present invention. This embodiment presents a three dimensional view of the apparatus 220 with an attached compact portable device 240. This is the "back side" of the apparatus 220 showing the other set of notches 230 that are available if the cups 222 were put on the opposite side of the apparatus 220.

Figure 20:
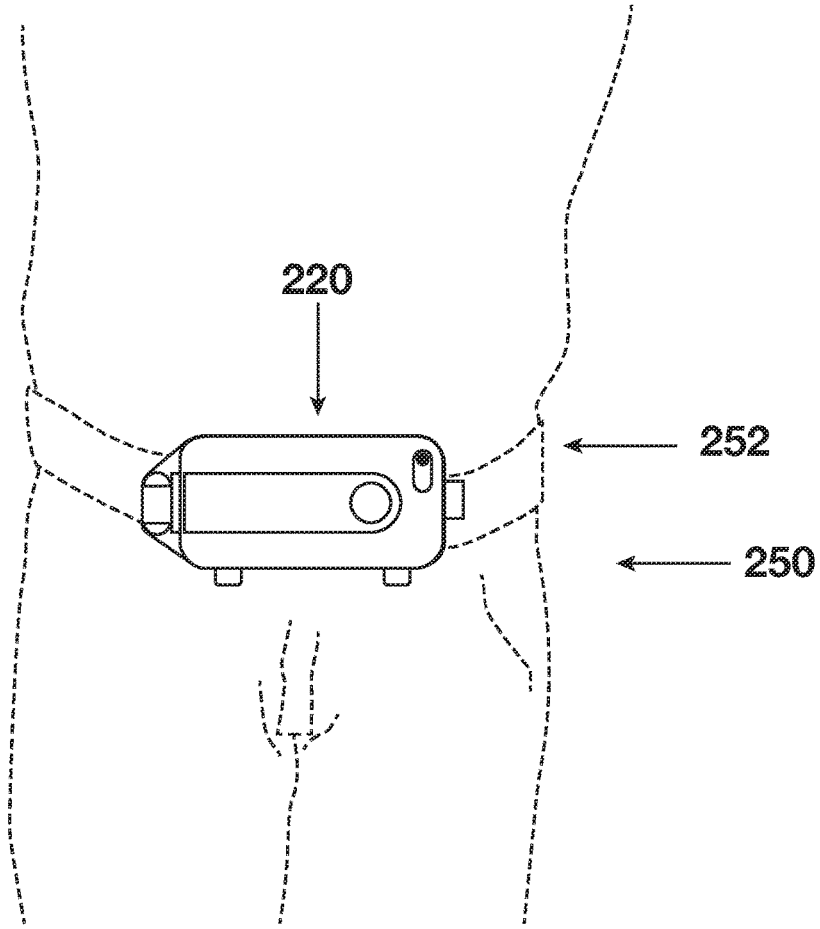
FIG. 20 is a view of the apparatus attached to an item in the representative form of a belt consistent with certain embodiments of the present invention.

Turning now to FIG. 20, this figure presents a view of the apparatus attached to an item in the representative form of a belt consistent with certain embodiments of the present invention. This embodiment presents the apparatus 220 attached to item 250 in the representative form of a belt 252.

Figure 21:
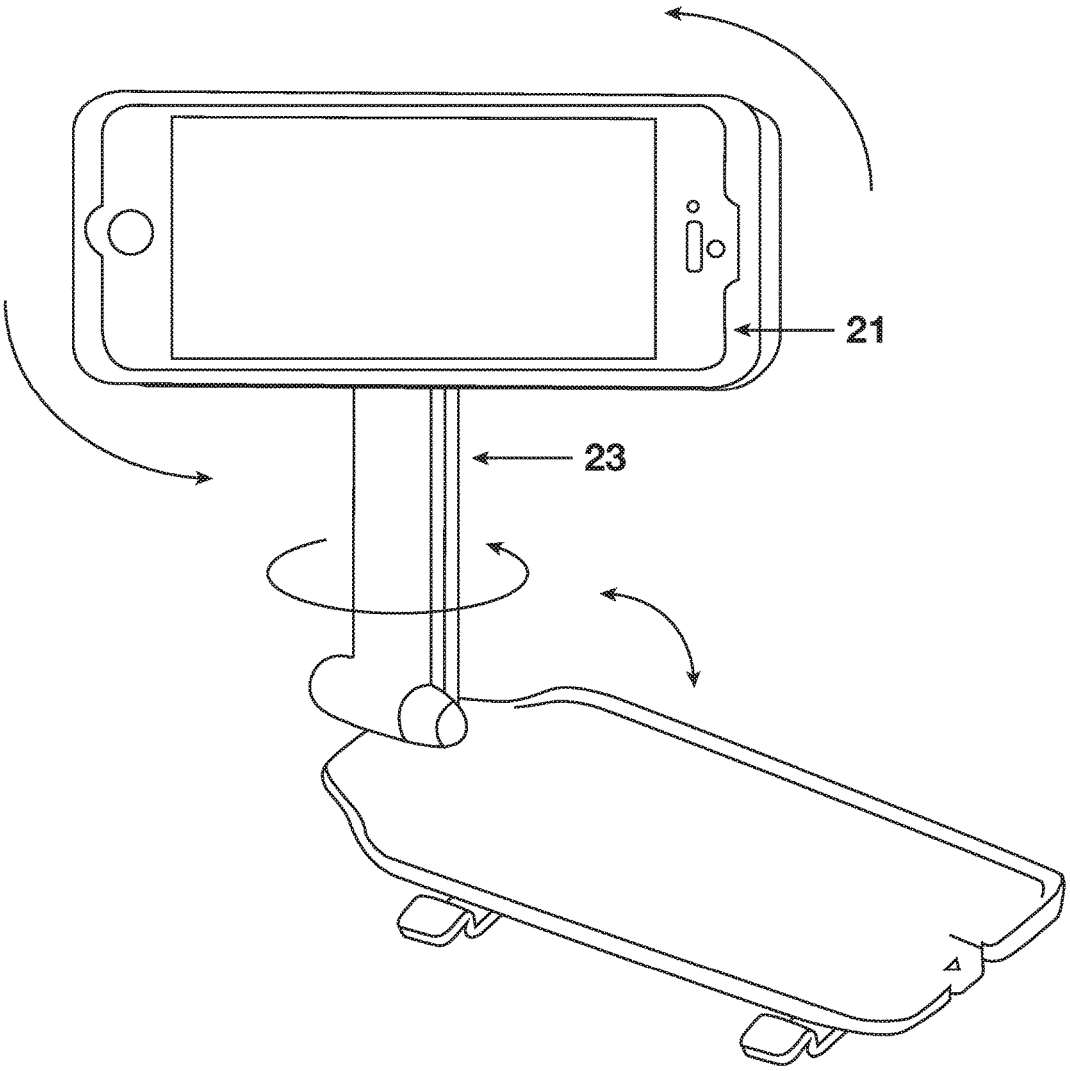
FIG. 21 is a view of the change in orientation of the top encasement from vertical to horizontal consistent with certain embodiments of the present invention.

Turning now to FIG. 21, this figure presents a view of the change in orientation of the top encasement from vertical to horizontal consistent with certain embodiments of the present invention. This embodiment presents the apparatus having a swivel mechanism at the distal end of the tongue 23 that swivels from a vertical orientation to a horizontal orientation to place the top casement 21 in a horizontal orientation when the tongue 23 is extended. The swivel permits the top casement 21 to be positioned 90 degrees to the left or 90 degrees to the right of the vertical orientation when the top casement 21 is in a parallel configuration to the tongue 23. The swivel is configured to lock into position to preserve the horizontal view of the display screen associated with the mobile device installed within the top casement 21.

Figure 22:
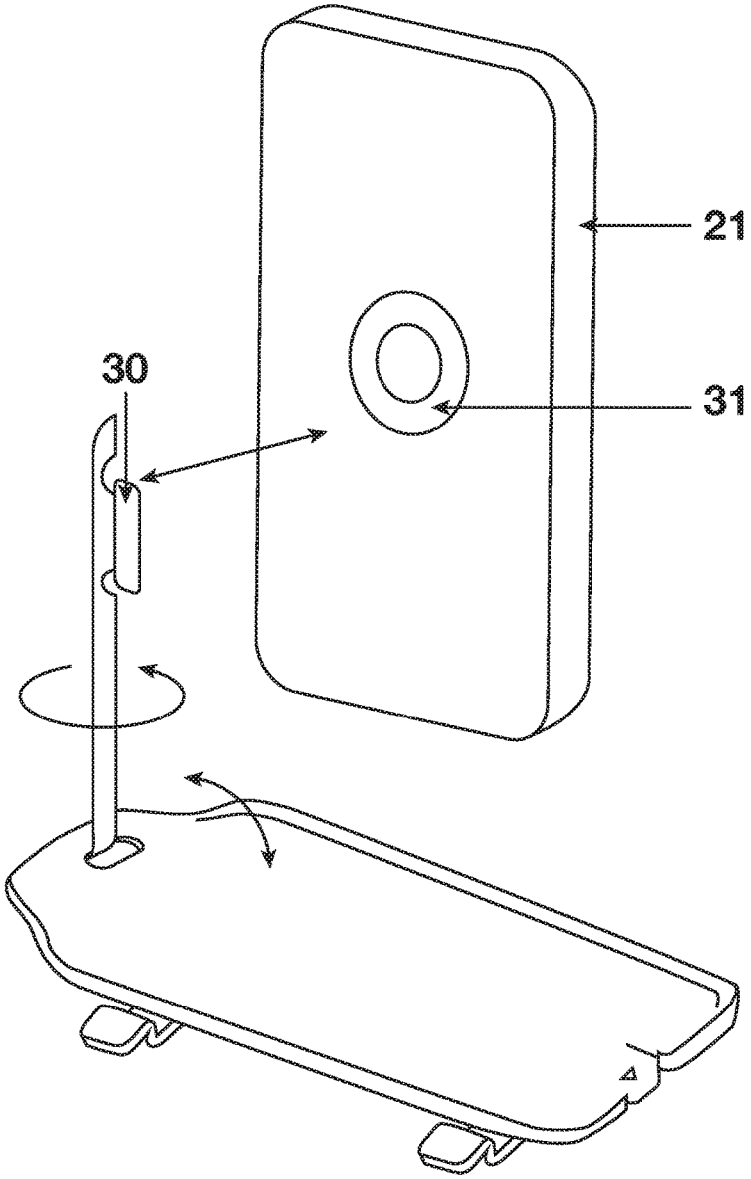
FIG. 22 is a view of the detachment of the top casement from the tongue element consistent with certain embodiments of the present invention.

Turning now to FIG. 22, this figure presents a view of the detachment of the top casement from the tongue element consistent with certain embodiments of the present invention. The top casement 21 may be configured to be fully detachable from a rotating swivel component 30 of the tongue portion of the apparatus. The rotating swivel component 30 may be configured to rotate from a vertical orientation to a horizontal orientation when the tongue 23 is fully extended. This swivel permits the top casement 21 to be placed in a horizontal orientation as well as a vertical orientation, where the top casement is configured in parallel with the base portion of the apparatus. The top casement 21 may have a swivel connection 31 that is configured to be attached and detached from the rotating swivel component 30. The swivel connection 31 is an integral portion of the top casement 21. When the top casement 21 is placed in contact with the tongue, the rotating swivel component 30 is positioned to come into contact with the swivel connection 31. The user may then apply sufficient force to lock the swivel component 30 into the swivel connection 31, permitting the top casement to rotate from vertical to horizontal orientation without becoming detached from the tongue. When the user desires to detach the top casement 21 from the tongue, the user simply pulls on the top casement 21 with sufficient force to unlock the swivel component 30 from the swivel connection 31.

With reference to further details of the further aspect of the present invention, there is provided a unit consisting of a top encasement, a base plate, a rotating mechanism, a tongue extension, and a "clenching" clip attached to the base plate. The unit consists of moving parts which provide the ability of the user to wear, attach (to a belt or strap for example), tilt open the top encasement up to and including 270 degrees (although the typical degree of tilt is about 180 degrees, this may be extended to include 270 degrees), rotate the top encasement from side to side up to and including 90 degrees (although typical degrees of rotation may be about 45 degrees) in either direction, and rotate the top encasement around 360 degrees freely in either direction. Any number of angles and used independently or simultaneously in the X, Y, and/or Z axes. The compact portable device may or may not include a viewing screen. The compact portable device is representative of any one of a number of devices such as but not limited to examples such as a personal digital assistant (PDA), cellular telephone, smart device, smart phone, tablet, "note" style tablet, portable music media player, video game device, and satellite radio receiver. The rotating mechanism is to include but not limited to; being a part of the actual chassis of the compact portable device, a part of the top encasement that surrounds the compact portable device, or part of the base plate of the unit itself to which the top encasement can be attached. In this illustration, for example, the rotating mechanism is made possible by the design and assembly of the mechanism configured within the baseplate.

The top encasement can be closed onto the base plate in a manner such that it can be selectively orientated; allowing the viewing screen to be seen or hidden if applicable. When the encasement is not closed, it can be selectively oriented with the top encasement extended outwardly to any degree up to 270 degrees and turned and rotated any degree up to and including 360 degrees for viewing the viewing screen of the compact portable device if applicable.

The top encasement, which holds the compact portable device, is attachable and detachable to the base plate via the tongue extension of the base plate for example, which attaches to the back of the encasement. This tongue extension can be extended at least 2 to 3 times the length of the device holder itself. The tongue extension is to include but not limited to: being a part of the actual chassis of the compact portable device, a part of the top encasement that surrounds the compact portable device, or part of the base plate of the unit itself by which the top encasement can be attached. The tongue can be extended out do any desired length until the top encasement can actually be taken off.

The clenching clip allows the user to attach the unit to a number of items with varying thicknesses securely. The clenching clip allows the user to control the amount of closure needed for clipping the unit to an article such as a strap or belt for example. Often, straps are vertical and the ability to keep the unit from sliding down requires a firm steady attachment. This clenching clip gives the tight secure hold that is needed. The unit can be attached without using the "notches" if desired. The first "notch" allows for a thicker item, the second—a little thinner, the third—even thinner and so on.

In one aspect the user can attach the unit to a purse for example, and keep the top encasement closed facing out or closed facing in. In another aspect, the user can attach the unit to a belt for example, tilt the top encasement out any degree decided between zero and 270, tilt the top encasement in either direction any number of angles pull the top encasement out to any desired length on the tongue, and in addition, rotate the top encasement from zero to 360 degrees and either direction they decide in order to view the compact portable device, which is secured inside of the top encasement. The user therefore, is given the freedom to lie down, stand, walk, hike, bike, etc. and still have immediate, hands free access to the compact portable device with an extra-long extension (if desired) without having to remove it from the unit. It allows the user to extend the device and at the same time have numerous varying degrees of tilt and rotate of said apparatus simultaneously.

The unit also permits a user to selectively detach the compact portable device from the unit and to selectively place the unit, with the compact portable device thus detached, in a disposition in which the top encasement and the base plate are disposed in generally facing relationship to one another, or in a disposition in which the top encasement and the base plate are not disposed in generally facing relationship to one another, i.e., the top encasement may be swiveled relative to the base plate. If the top encasement and the base plate are not disposed in generally facing relationship to one another, i.e., if the top encasement is swiveled at an angle to the base plate, the user can conveniently re-attach the compact portable device to the top encasement and then be able to immediately view the viewing screen on the thus re-attached compact portable device.

While specific embodiments of the invention have been illustrated and described herein, it is realized that numerous modifications and changes will occur to those skilled in the art. It is therefore to be understood that the intricacies within the general descriptions are to be covered under modifications and changes as fall within the true spirit and scope of the invention.

While certain illustrative embodiments have been described, it is evident that many alternatives, modifications, permutations and variations will become apparent to those skilled in the art in light of the foregoing description.

What is claimed is:

1. A device for securing a compact portable device to an article, comprising:

a base plate attachable to the article;

a detachable encasement panel associated with the base plate;

a tilt and rotate element attached to the base plate and having a tongue extension which is attached to the detachable encasement panel so as to permit the encasement panel to tilt and to permit zero to 360 degree rotation simultaneously during varying degrees of tilt with relation to the base plate;

the tongue extension from the base plate permitting an attachment and detachment of the detachable encasement panel and where the tongue extension element is extendable;

a fastening arrangement attached to the base plate to permit attachment of the device to an article associated with a user;

a swivel component attached to a swivel connection to permit the encasement panel to swivel from a vertical orientation to a horizontal orientation with respect to the tongue extension; and where the device provides the user with the ability to tilt and rotate the detachable encasement panel and hold the detachable encasement panel in any desired position to permit hands free access to a compact portable device inserted into said detachable encasement panel.

2. The device of claim 1, where the fastening arrangement further comprises a connection element connected to the base plate and permitting a secure attachment of the device to an article of clothing, purse, bag, backpack, or other item associated with a user.

3. The device of claim 2, where the connection element comprises a clip having an adjustable clench capability for a secure attachment to an article or other item associated with the user.

4. The device of claim 1, where the tilt and rotate element permits a tilt angle between the base plate and the detachable encasement panel from 0 degrees to 270 degrees.

5. The device of claim 1, where the tilt and rotate element permits a 360 degree rotation of the detachable encasement panel with relation to the base plate.

6. The device of claim 1, where the tongue extension of the base plate is fully insertable into the detachable encasement panel and the detachable encasement panel is fully detachable from the tongue extension of the base plate.

7. The device of claim 1, where the tilt and rotate element permits a user to orient a compact portable device inserted within the detachable encasement panel in a facing or non-facing relationship with the base plate.

8. The device of claim 3, where the adjustable clench capability permits a user to selectively vary the retaining force with which the base plate is attached to an article of clothing, purse, bag, backpack, or other article associated with a user.

9. The device of claim 1, where the swivel component is formed at the distal end of the tongue extension.

10. The device of claim 1, where the swivel component is attached and detached from a swivel attachment that is positioned in the center point of the back of the encasement panel.

* * * * *